US007928303B2

(12) United States Patent
Millender, Jr. et al.

(10) Patent No.: US 7,928,303 B2
(45) Date of Patent: Apr. 19, 2011

(54) INSERT FOR CAJON DRUM

(75) Inventors: Samuel Earl Millender, Jr., San Rafael, CA (US); Jesse M. Bradman, Petaluma, CA (US)

(73) Assignee: Riley Investments LLC, Petaluma, CA (US)

( * ) Notice: Subject to any disclaimer, the term of this patent is extended or adjusted under 35 U.S.C. 154(b) by 0 days.

(21) Appl. No.: 12/583,783

(22) Filed: Aug. 26, 2009

(65) Prior Publication Data

US 2010/0031802 A1 Feb. 11, 2010

Related U.S. Application Data

(63) Continuation-in-part of application No. 12/072,867, filed on Feb. 28, 2008, now Pat. No. 7,582,820.

(51) Int. Cl.
*G10D 13/02* (2006.01)

(52) U.S. Cl. ..... 84/411 R; 84/294; 381/349; 181/156

(58) Field of Classification Search ..... 84/411 R, 84/294; 181/156; 381/349
See application file for complete search history.

(56) References Cited

U.S. PATENT DOCUMENTS 494,485 A * 3/1893 Nightingale ..... 84/294
740,485 A * 10/1903 Van Gelder ..... 84/294
818,289 A * 4/1906 Tann ..... 84/294
1,691,168 A * 11/1928 Rapsevez ..... 84/294
3,621,749 A * 11/1971 Aluisi ..... 84/411 R
4,284,166 A * 8/1981 Gale ..... 181/156
4,742,753 A * 5/1988 Speed ..... 84/414
4,805,514 A * 2/1989 Billings ..... 84/411 M
5,095,796 A * 3/1992 Genna ..... 84/414
5,115,473 A * 5/1992 Yamagishi et al. ..... 381/338
D359,958 S * 7/1995 Frodelius ..... D14/208
5,623,132 A * 4/1997 Gahm ..... 181/156
5,696,357 A * 12/1997 Starobin ..... 181/156
5,892,183 A * 4/1999 Roozen et al. ..... 181/156
6,057,499 A * 5/2000 Basmadjian ..... 84/411 R
6,198,033 B1 * 3/2001 Lovelett ..... 84/411 R
6,275,597 B1 * 8/2001 Roozen et al. ..... 381/345
6,677,512 B1 * 1/2004 Chen ..... 84/411 R
6,700,044 B1 * 3/2004 Bencomo, Jr. ..... 84/411 R
7,039,212 B2 * 5/2006 Poling et al. ..... 381/349
7,074,992 B2 * 7/2006 Schmidt ..... 84/294
7,291,776 B2 * 11/2007 Dunnett ..... 84/411 R
7,582,820 B2 * 9/2009 Millender et al. ..... 84/411 R (Continued)

OTHER PUBLICATIONS

Tubo Bass-Reflex, bass reflex tubes, viewed at http://www.twenga.es/dir-Audio-Video,Altavoces-Hi-Fi,Tubo-Bass-Reflex Sep. 30, 2010.*

(Continued)

*Primary Examiner* — Elvin G Enad
*Assistant Examiner* — Robert W Horn
(74) *Attorney, Agent, or Firm* — Bruce H. Johnsonbaugh

(57) ABSTRACT

An apparatus is provided for lowering the fundamental frequency of a cajon drum. A first side wall of the cajon drum is the drumhead. An opening is formed in a second side wall, wherein the opening may be circular, oval, rectangular or other shape. An insert having a cross-section conforming to the shape of the opening is slid into the opening and mounted to the side wall in which the opening is formed. Various techniques for connecting the insert to the side wall of the drum are disclosed. The insert may be fitted into the drum opening during the initial manufacture of the drum.

1 Claim, 6 Drawing Sheets

U.S. PATENT DOCUMENTS

| | | | | |
|---|---|---|---|---|
| 7,659,469 | B2 * | 2/2010 | Belli | 84/411 R |
| 7,674,963 | B1 * | 3/2010 | Poggi | 84/312 R |
| 7,840,022 | B2 * | 11/2010 | Matsumura et al. | 381/345 |
| 2008/0078279 | A1 * | 4/2008 | Belli | 84/411 R |
| 2009/0019985 | A1 * | 1/2009 | Casanta | 84/411 R |
| 2010/0031802 | A1 * | 2/2010 | Millender et al. | 84/411 R |
| 2010/0037750 | A1 * | 2/2010 | Millender et al. | 84/411 R |

OTHER PUBLICATIONS

Bass Reflex Tubes, viewed at http://www.lautsprechershop.de/hifi/rohre_en.htm?xxx Sep. 30, 2010.*

* cited by examiner

INSERT FOR CAJON DRUM

CROSS REFERENCE TO RELATED APPLICATION

This application is a continuation-in-part of U.S. application Ser. No. 12/072,867, filed Feb. 28, 2008 now U.S. Pat. No. 7,582,820.

BACKGROUND AND BRIEF SUMMARY OF INVENTION

This application pertains to an insert that is capable of significantly improving the sound of a cajon drum. Cajon drums are becoming increasingly popular worldwide.

Cajon drums are believed to have been descended from wooden shipping crates by Peruvian slaves in the early 1800s. The cajon drums used today retain the basic, boxlike design. Rather than using a flexible, batter head membrane, cajon drums continue to generally use a six-sided plywood box with a somewhat thinner plywood head. Some cajon drums have five sides, including four side walls and a top. The user strikes the head (formed by a first side wall) by hand. An opening is formed in a second side wall, either in the wall opposite from the drumhead or in a wall adjacent the drumhead. The opening may be circular, oval or rectangular.

The applicants have discovered, to their surprise, that the same insert described in the parent application, U.S. Ser. No. 12/072,867 (hereby incorporated by reference), has a significant effect on the output of a cajon drum. The most surprising result is that the fundamental frequency of the cajon drum is lowered, creating a surprisingly different and pleasant sound compared with playing the drum without the insert. Inserts of alternate designs described herein also have shown surprising results.

The object of the invention is to provide an insert usable in a wooden, cajon drum that lowers the fundamental frequency of the drum.

Other objects will become apparent from the following description and drawings.

DETAILED DESCRIPTION OF DRAWINGS

Figure 1:
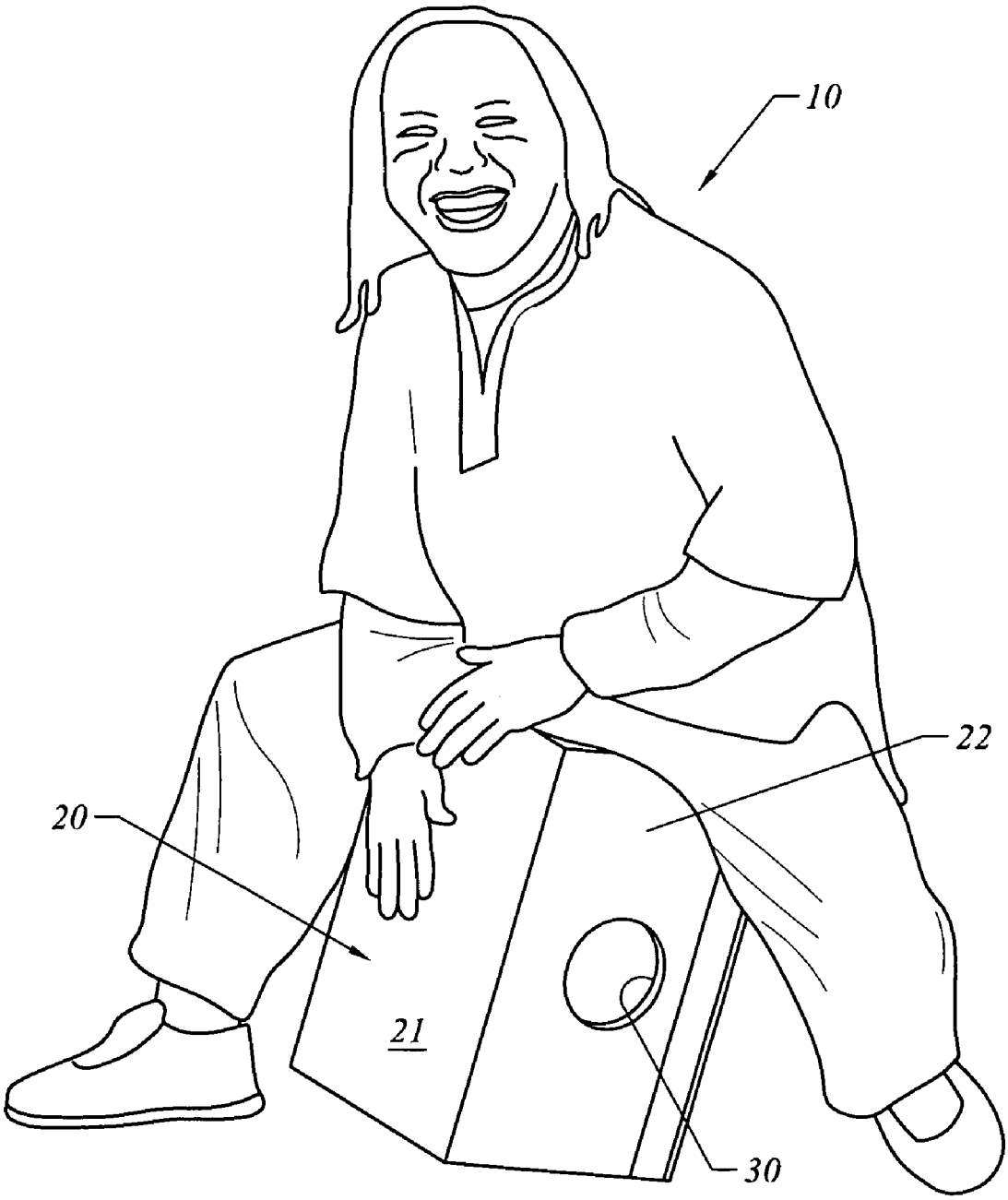
FIG. 1 (Prior Art)
FIG. 1 illustrates how a typical cajon prior art drum is played, namely, by a drummer sitting astride the drum and beating the drumhead with his bare hands.

Although there are several varieties of cajon drums, a common design is shown in FIG. 1 wherein a drummer 10 sits astride the drum shown generally as 20. The cajon drum 20 is essentially a six-sided box with the four side walls made of plywood. Five of the six sides of the box are generally made of 0.25 inch to 0.75 inch thick plywood. Some cajon drums have four side walls, a top and an open bottom.

The head (shown as 21 in FIG. 1) or tapa is typically made of thinner plywood, such as 0.125 inch plywood, and is the striking surface or head of the drum formed in first side wall 21. A circular opening 30 is formed in a second side wall, either in the wall opposite the head or in an adjacent wall 22 as shown in FIG. 1. Opening 30 may be any shape, such as circular, oval, rectangular as examples.

Figure 2:
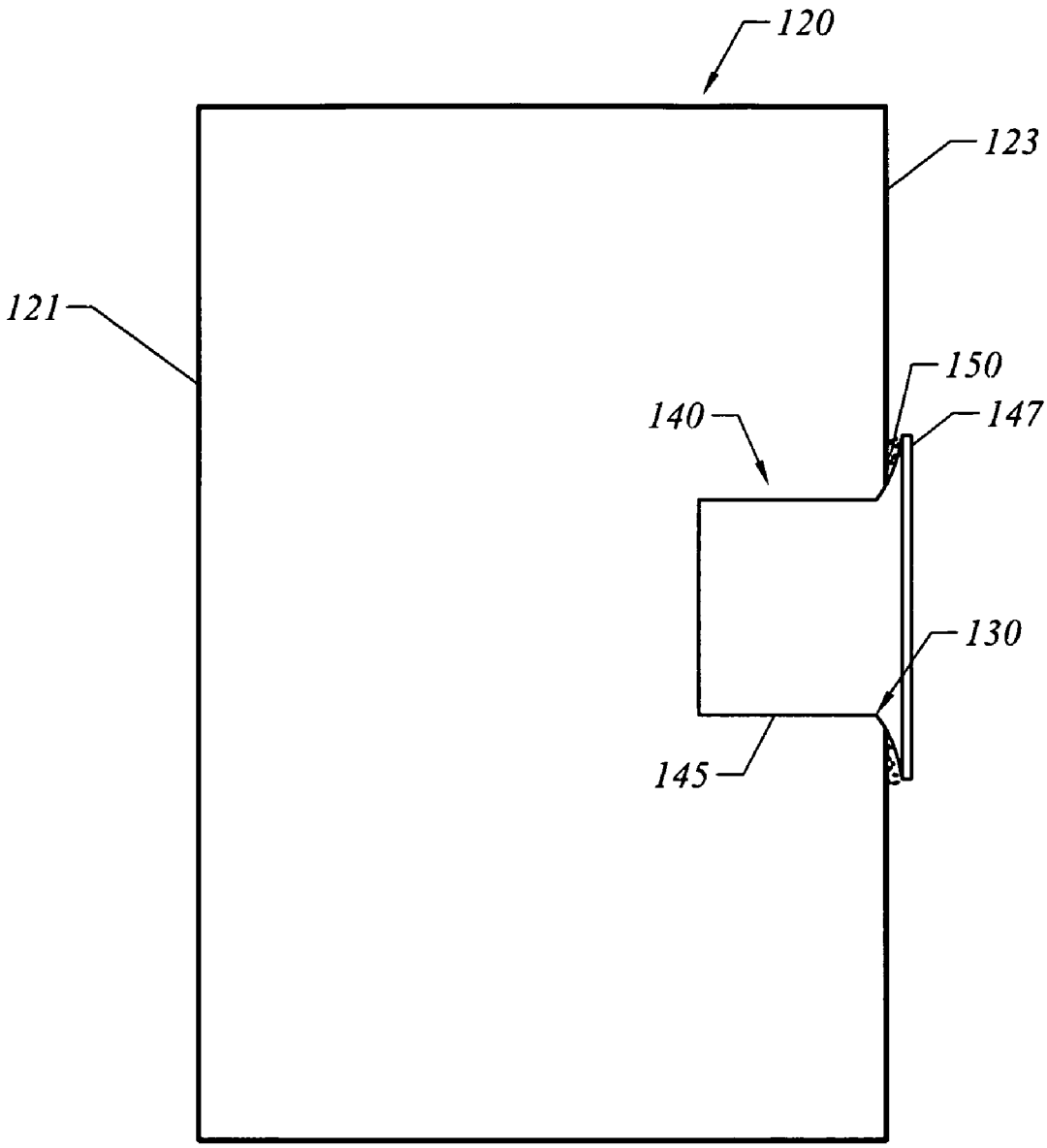
FIG. 2 illustrates one embodiment of an insert according to the present invention that is applied to the opening in the cajon drum shown in FIG. 1.

As shown in FIG. 2, an insert 140 is slid into the circular opening 130 in back wall 123 of cajon drum 120. The insert 140 acts to deepen the tone of the drum by lowering the fundamental frequency of the drum. A complete description of fundamental frequency (and the weight and dimensions of the insert) is given in Ser. No. 12/072,867 and is not repeated here in the interest of brevity.

Insert 140 has a cylindrical body 145 to conform to circular opening 130. A flared flange 147 extends outwardly from the outer end 145*a* of cylindrical body 145. The inner end 145*b* of the cylindrical body 145 remains open. As a specific example, an insert having a diameter of four inches, a length of six inches and a weight of 7.3 ounces was utilized. It was slid into the circular opening of a cajon drum having a height of 18 inches and each side wall having a width of 13 inches. The head of the drum had a thickness of 0.125 inch. The back wall (into which the insert was slid) had a thickness of 0.25 inch. The insert was attached with a mounting means 150 which, in the example described, was Velcro. The fundamental frequency was lowered significantly.

The flared flange 147 is attached to the wall 123 of the cajon drum 120 by any one of several mounting means 150, including adhesive, Velcro, double sided tape, or any other attachment device that securely holds the insert to the side wall of the cajon drum.

It is significant to note that the invention applies to cajon drums of any size.

Figure 3:
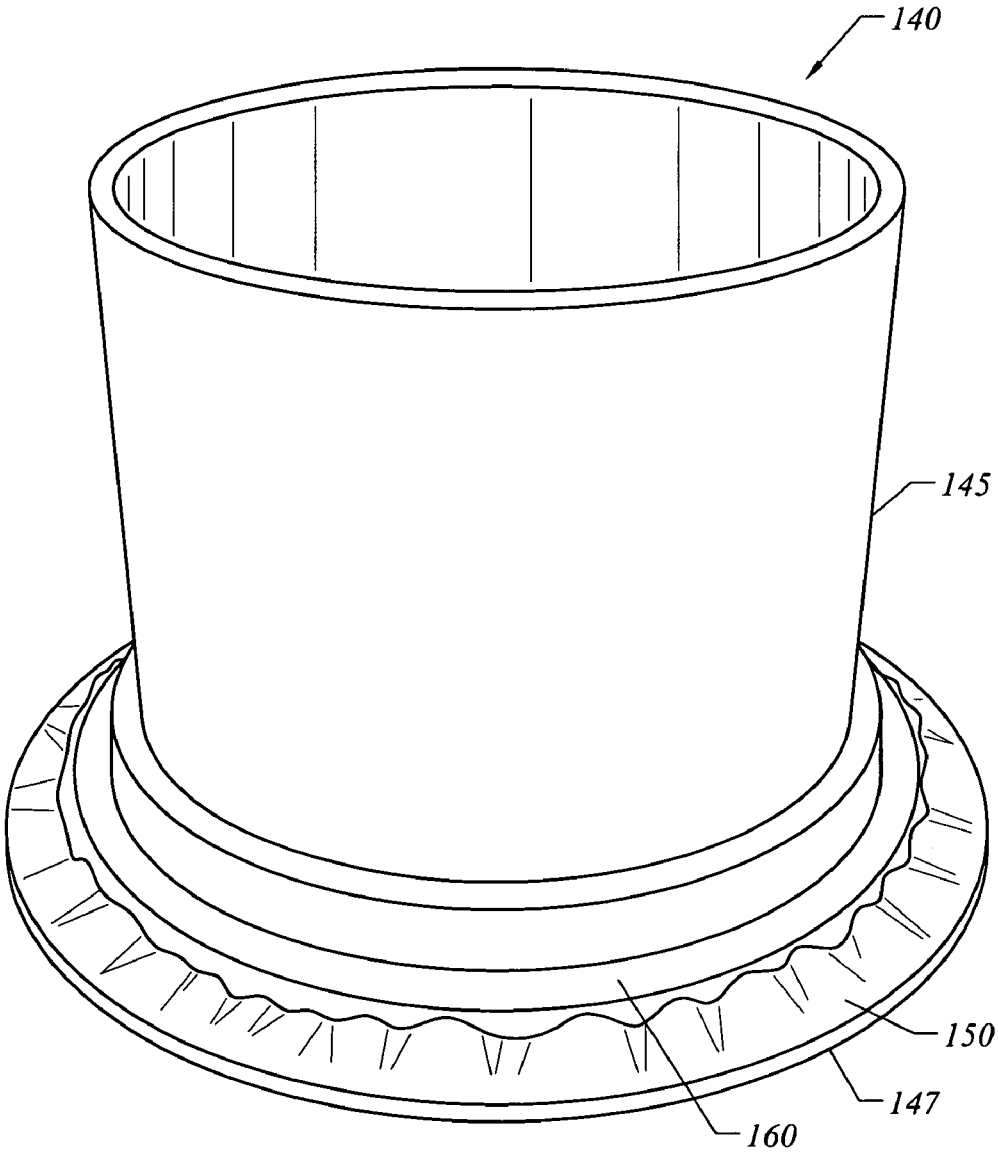
FIG. 3 is a perspective view of the insert 140 of FIG. 2 shown apart from drum 120.

FIG. 3 shows insert 140 apart from drum 120. Mounting means 150 is Velcro. A foam band 160 extends around cylindrical body 145 adjacent flange 147. Foam band insulates cylindrical body 145 from the wall 123 in which the insert 140 is mounted.

Figure 4:
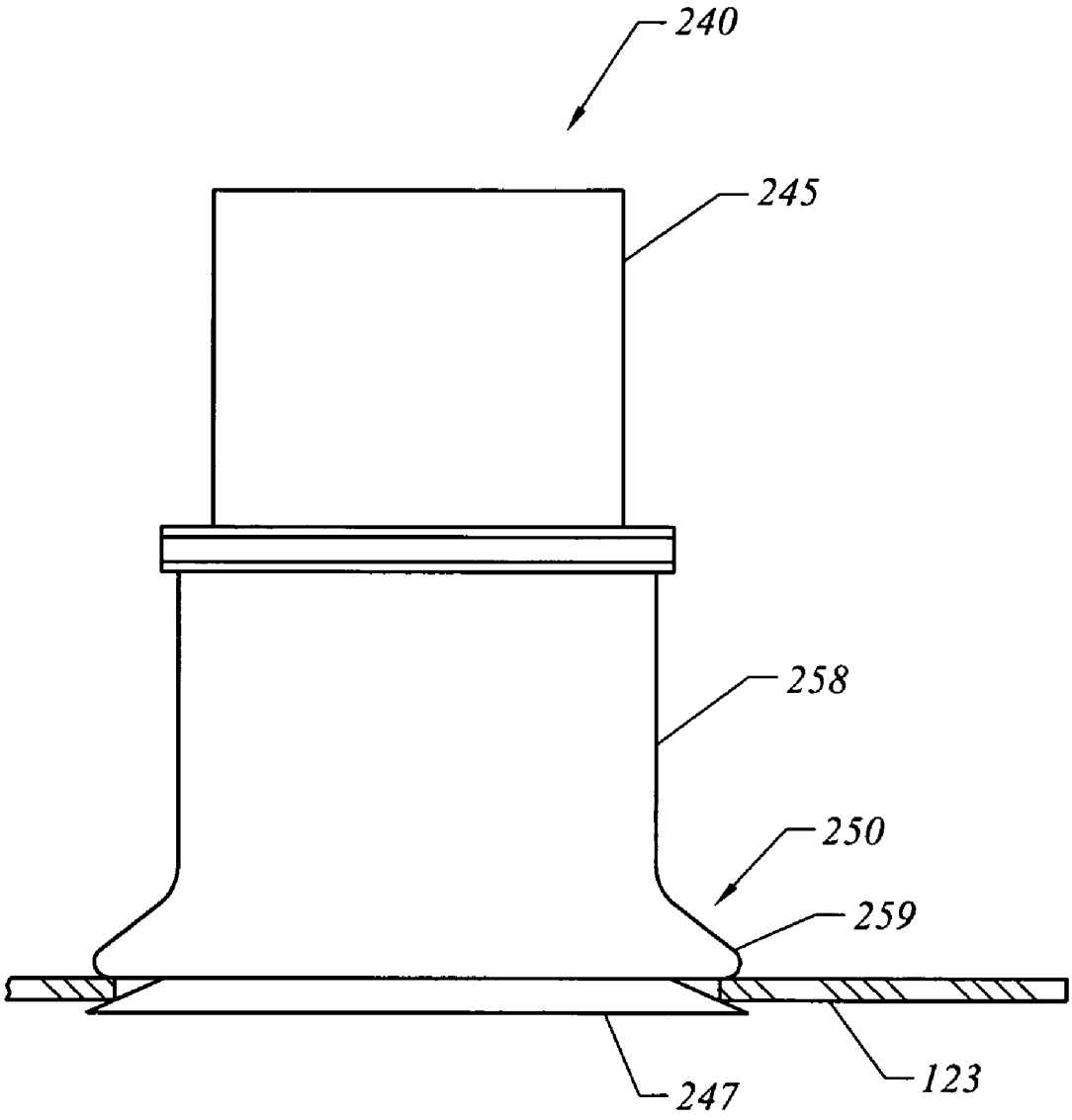
FIG. 4 illustrates an alternate insert which utilizes a flexible rubber sleeve to mount the insert to the cajon drumhead.

FIG. 4 shows an alternate mounting means 250, in which a flexible rubber sleeve 258 is carried by cylindrical body 245. Sleeve 258 has a flange 259 that bears against wall 123. Insert 240 is held in place by pressure on wall 123 by flange 259 and flange 247.

Figure 5:
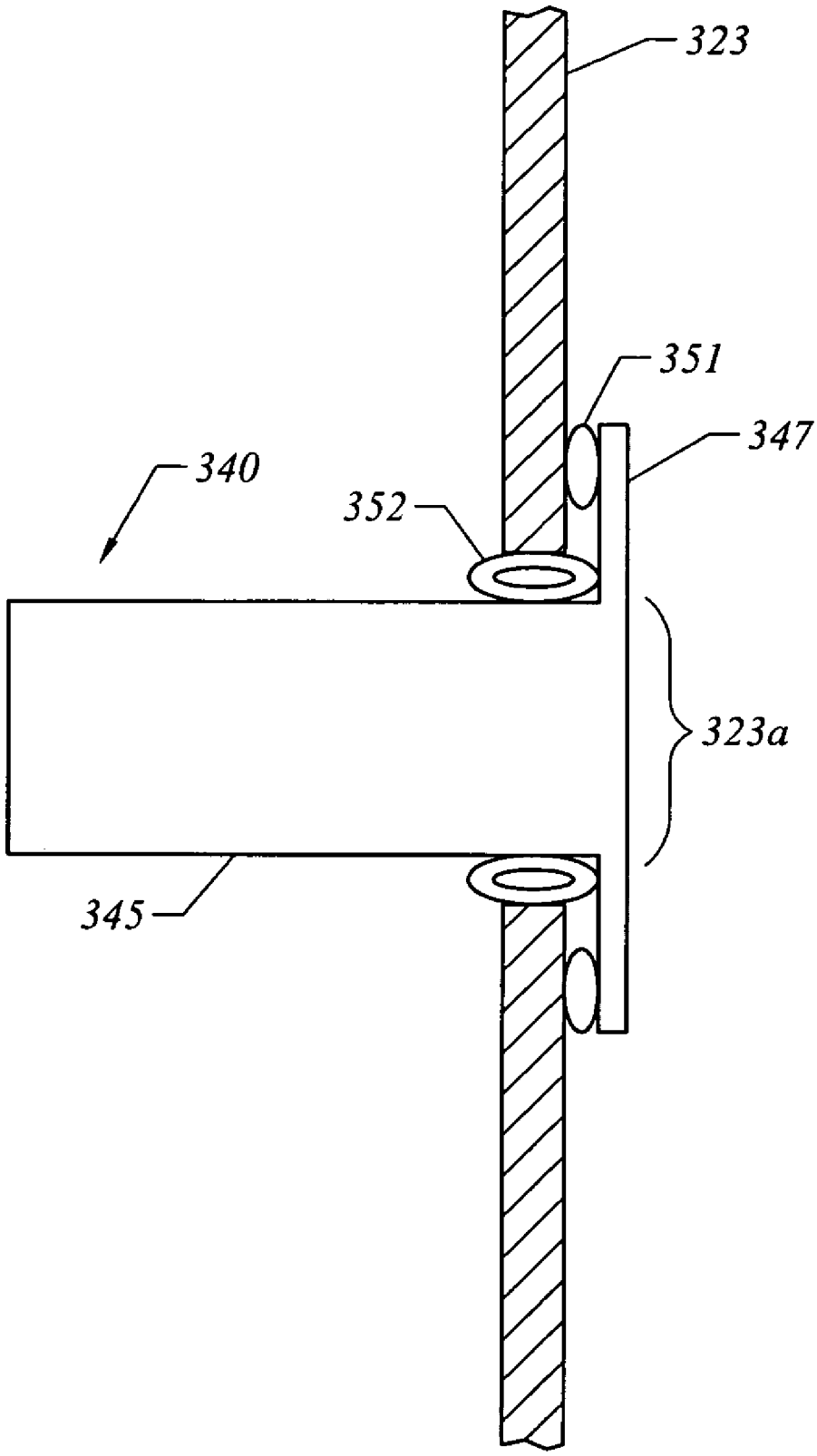
FIG. 5 illustrates a further embodiment of the invention wherein the insert has a non-flared flange which is utilized to attach the insert to the drumhead.

FIG. 5 illustrates another embodiment of the invention wherein insert 340 is carried by the back wall 323. It is to be understood that the opening 323*a* formed in wall 323 may be circular, oval, rectangular or other shape. Insert 340 has a body 345 that is attached to a flange 347. Body 345 has a cross-section that conforms to the shape of opening 323*a*, so that insert 340 slides into opening 323*a*. Flange 347 in this embodiment is not flared. It is simply a perpendicular radially extending flange from body 345. A rubber mounting doughnut 352 is carried by the body 345 of insert 340 and is slightly deformed to the elliptical shape shown in FIG. 5 as insert 340 is slid into opening 323*a*. A foam mounting buffer ring 351 is placed between flange 347 and drumhead 323 to reduce or prevent vibrations otherwise caused by contact between flange 347 and drumhead 323.

Figure 6:
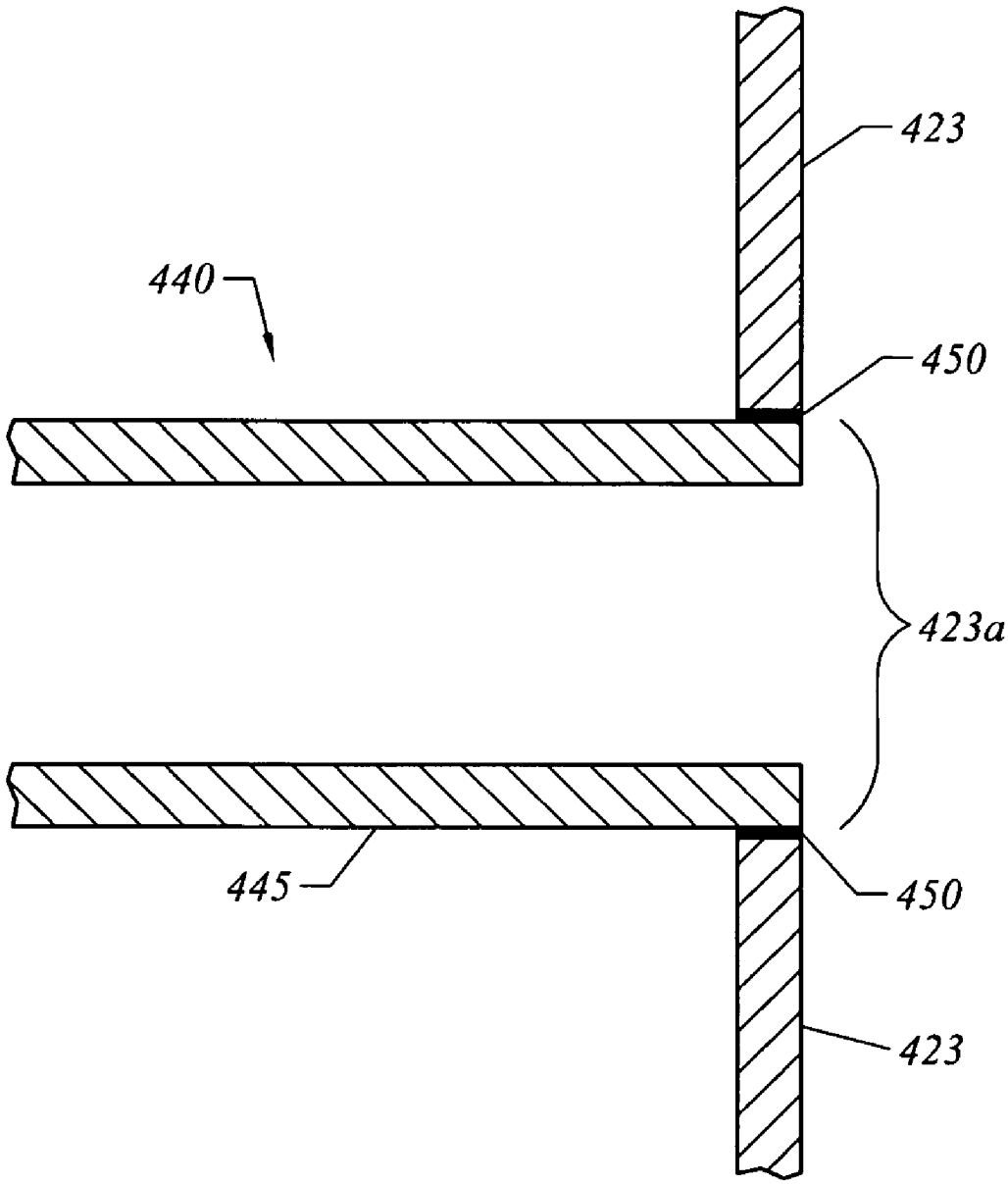
FIG. 6 illustrates still a further embodiment of the invention wherein the insert does not have a flange, has a cross-section that allows it to be slid into the opening in the drumhead and is simply attached to the drumhead by adhesive.

FIG. 6 illustrates a further embodiment of the invention wherein the cajon side wall 423 has an insert 440 carried by opening 423*a*. Insert 440 in this embodiment is a non-flanged insert whose cross-section conforms to the shape of opening 423*a*. If opening 423*a* is circular, insert 440 has a cylindrical body 445. Body 445 is attached to side wall 423 preferably by adhesive 450. It is significant to note that, in this embodiment, the insert 440 may be placed in drumhead 423 during the manufacture of the drum, itself. Alternately, the insert 440 can be placed into opening 423*a* by being simply slid into position and adhesive 450 being applied when insert 440 approaches its final position shown in FIG. 6.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. Apparatus for lowering the fundamental frequency of a cajon drum, wherein said drum comprises four wooden side walls and a wooden top, wherein a first wooden side wall is the drumhead, wherein an opening is formed in a second side wall of said drum, comprising:

a cylindrical insert, said cylindrical insert having a cylindrical body, said body being adapted to be slid into said opening, said insert having a flared flange at the outer end of said body and mounting means for connecting said insert to said second wooden side wall, wherein said mounting means includes a resilient band extending around said body adjacent said flange, and said mounting means also includes a resilient ring between said flange and said second wooden side wall, whereby said insert and said flange are resiliently suspended relative to second side wall to reduce vibrations otherwise caused by contact between said insert and said second side wall and to allow said insert to move relative to said side wall.

wherein the weight of said insert and the length and width of said body of said insert are sized to lower the fundamental frequency of said drum.

* * * * *